US008408278B2

(12) United States Patent
Banno et al.

(10) Patent No.: US 8,408,278 B2
(45) Date of Patent: Apr. 2, 2013

(54) AUTOMATIC POURING METHOD

(75) Inventors: Kouichi Banno, Nagoya (JP); Toshiyuki Hyoudo, Nagoya (JP); Tadashi Nishida, Nagoya (JP)

(73) Assignees: Sintokogio, Ltd., Aichi (JP); Fujiwa Denki Co., Ltd., Aichi (JP)

( * ) Notice: Subject to any disclaimer, the term of this patent is extended or adjusted under 35 U.S.C. 154(b) by 0 days.

(21) Appl. No.: 13/262,478

(22) PCT Filed: Mar. 19, 2010

(86) PCT No.: PCT/JP2010/054791

§ 371 (c)(1),
(2), (4) Date: Dec. 19, 2011

(87) PCT Pub. No.: WO2010/113676

PCT Pub. Date: Oct. 7, 2010

(65) Prior Publication Data

US 2012/0097359 A1 Apr. 26, 2012

(30) Foreign Application Priority Data

Apr. 2, 2009 (JP) ..... 2009-090249

(51) Int. Cl.
*B22D 39/04* (2006.01)

(52) U.S. Cl. ..... 164/135; 164/136; 164/457; 164/336; 164/337

(58) Field of Classification Search ..... 164/135, 164/136, 155.1, 155.2, 335–337, 457; 222/604
See application file for complete search history.

(56) References Cited

U.S. PATENT DOCUMENTS 4,084,631 A * 4/1978 Kunzmann ..... 164/155.2
4,299,268 A * 11/1981 Lavanchy et al. ..... 164/155.2

FOREIGN PATENT DOCUMENTS

JP 54-149326 11/1979
JP 06-344125 12/1994

(Continued)

OTHER PUBLICATIONS

International Search Report from the Japanese Patent Office for International Application No. PCT/JP2010/054791, mailing date May 11, 2010.

*Primary Examiner* — Kevin P Kerns
*Assistant Examiner* — Kevin E Yoon
(74) *Attorney, Agent, or Firm* — Finnegan, Henderson, Farabow, Garrett & Dunner, L.L.P.

(57) ABSTRACT

An automatic pouring method whereby a tilting automatic pouring device can pour at high speed, accommodating high-speed molding on a high-speed molding line. The method includes: a step wherein a pouring hopper, which can hold an amount of molten metal sufficient for multiple pours, is tilted forward, thereby pouring the molten metal from the hopper into a casting mold; a step wherein the pouring hopper is tilted backward, thereby stopping the aforementioned pouring into the casting mold; and a step wherein a set of casting molds, including the casting mold for which the aforementioned pouring has been completed, are moved at intervals. During the period from the beginning of the step in which molten metal is poured into the casting mold to the end of the step in which the set of casting molds is moved at intervals, whenever the weight of molten metal in the pouring hopper is less than a prescribed weight, molten metal is continually supplied to the pouring hopper by tilting a holding furnace forward.

1 Claim, 4 Drawing Sheets

FOREIGN PATENT DOCUMENTS

| | | | |
|---|---|---|---|
| JP | 07-214293 | 8/1995 | |
| JP | 09-164473 | 6/1997 | |
| JP | 11090616 A | * | 4/1999 |
| JP | 2001-321924 | | 11/2001 |

* cited by examiner

[Fig.1]
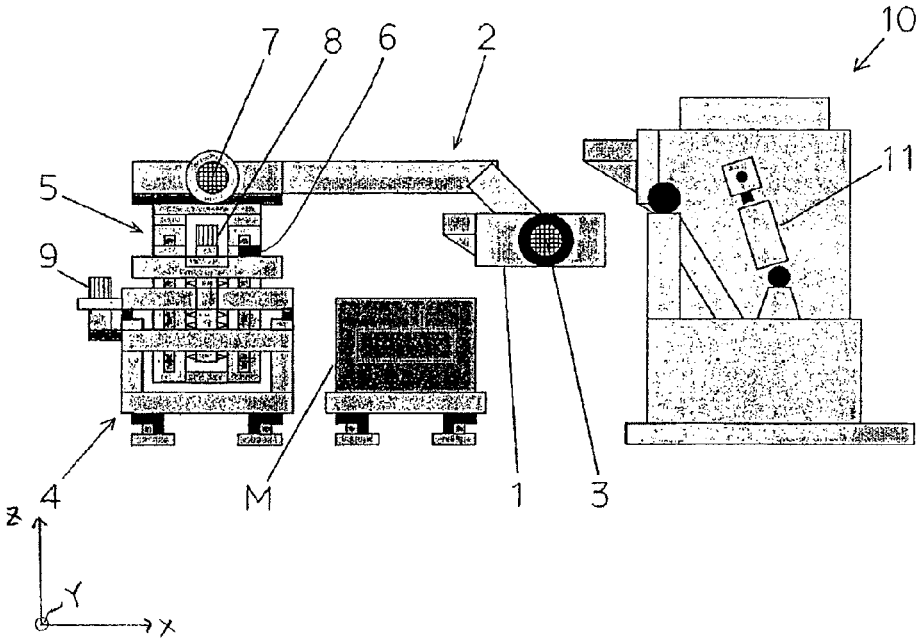

[Fig.2]
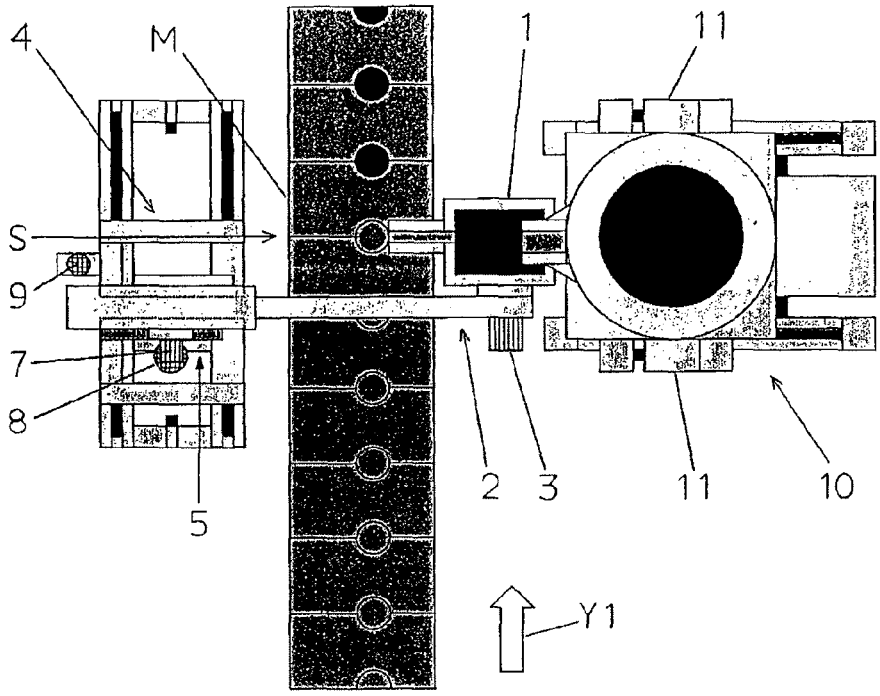
[Fig.3]
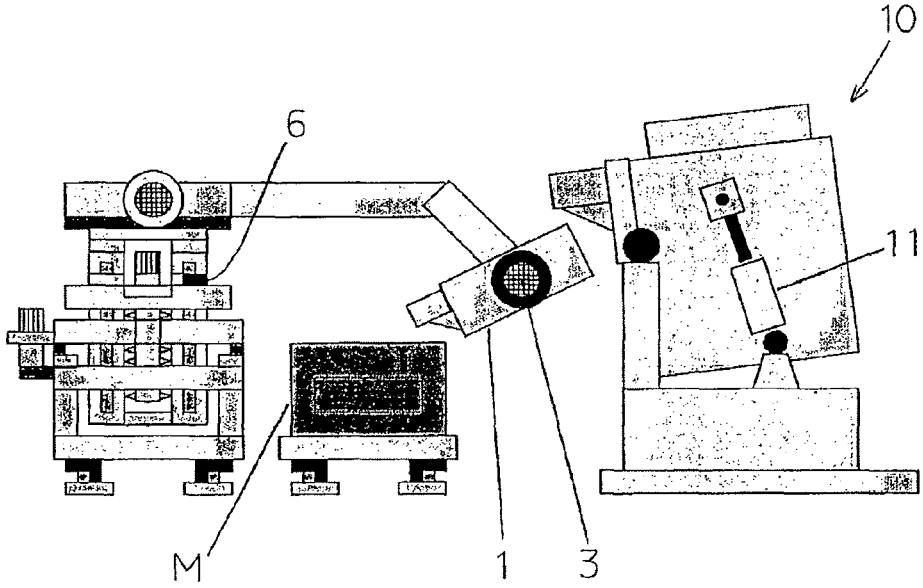

[Fig.4]
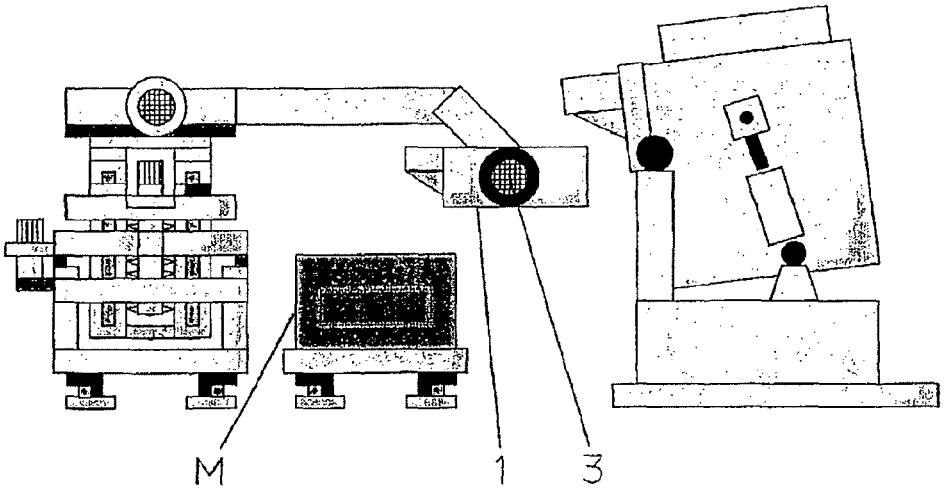

[Fig.5]
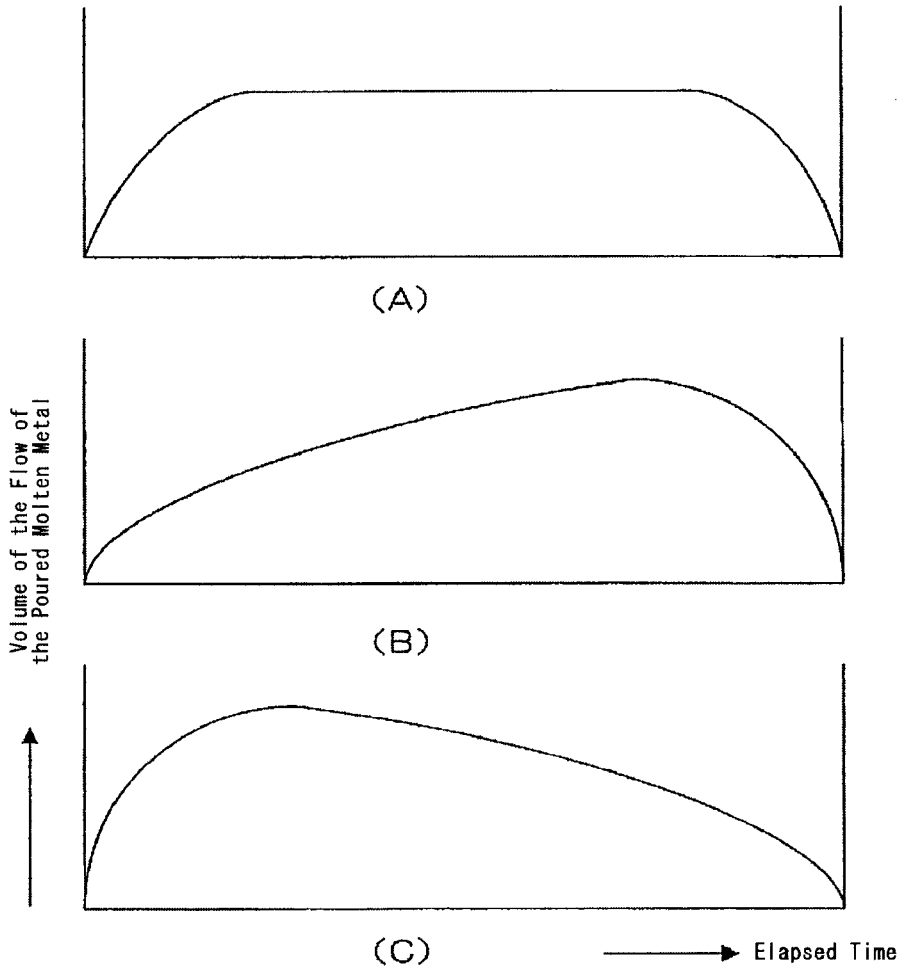

AUTOMATIC POURING METHOD

FIELD OF THE INVENTION

The present invention relates to a method for pouring molten metal into a mold. In particular the present invention relates to a method for automatically pouring molten metal into a mold.

BACKGROUND OF THE INVENTION

Conventionally, for instance, in a longitudinal flaskless molding line (see, e.g., Patent Literature 1), a pusher of a molding machine pushes out molds that are made therefrom such that the molds are intermittently conveyed on the line. Because such a high-speed molding line should inevitably provide a high-speed pouring, a stopper-type pouring machine (see, e.g., Patent Literature 2) that may be readily adapted to the high-speed pouring is often employed. In this stopper-type pouring machine, the stopper (stopper rod) opens and closes a pouring nozzle that is mounted on the bottom of a ladle. Molten metal is stored in the ladle when the pouring nozzle is closed by means of the stopper. The pouring nozzle opens by means of the stopper to pour the molten metal into a sprue of a mold under the pouring nozzle.

PRIOR-ART LITERATURE

Patent Literature

Patent Literature 1: Japanese Patent Laid-open Publication No. H09[1997]-164473 (FIG. 1)

Patent Literature 2: Japanese Patent Laid-open Publication No. H07[1995]-214293 (FIG. 1)

SUMMARY OF THE INVENTION

Problem to be Solved by the Invention

Such a stopper-type pouring machine, however, has a problem in that any molten metal may let it bleed if the stopper adheres to impurities or suffers an abrasion. Further, because it is necessary to maintain or exchange the stopper, as well as maintain the ladle, the maintenance involves significant times and costs. To avoid this problem, in a typical non-stopper-type automatic pouring machine, a ladle-tilting-type automatic pouring machine in which the ladle is tilted to pour the molten metal into the mold may be used. However, one problem is that this ladle-tilting-type automatic pouring machine has a significant difficulty in providing a high-speed pouring adapted to a high-speed molding process as in the above high-speed molding line.

In consideration of that problem, one object of the present invention is to provide a method for automatically pouring molten metal that enables the high-speed pouring to be adapted to the high-speed molding process in the high-speed molding line, even though this method employs the ladle-tilting-type automatic pouring machine.

Means to Achieve the Object of the Invention

To achieve the above object, the present invention provides a method for automatically pouring molten metal using an automatic pouring machine that includes a holding furnace for storing and holding the molten metal therein and for supplying the stored molten metal by forwardly tilting the holding furnace, a pouring hopper for receiving the supplied molten metal from the holding furnace and for enabling the storage therein of the received molten metal in a weight for more than one pouring, and tilting means for forwardly and inversely tilting the pouring hopper. The method includes the steps of forwardly tilting the pouring hopper and for pouring the molten metal into a mold therefrom, stopping the pouring of the molten metal into the mold by inversely tilting the pouring hopper, and intermittently conveying a group of molds that includes the molten-metal-poured mold. Further, the method is characterized in that if the weight of the molten metal within the pouring hopper has not reached a predetermined weight, then forwardly tilting the holding furnace to continue supplying the molten metal into the pouring hopper during a period of time between beginning the step for pouring the molten metal into the mold and the completion of the step for intermittently conveying the group of the molds is carried out.

In one embodiment of the automatic pouring method of the present invention, in the step for pouring the molten metal into the mold, the weight of the molten metal within the pouring hopper is measured over predetermined repeated periods of time, deriving the difference in the flow volume that flows out from the pouring hopper based on the measured weight of the molten metal, and deriving the actual volume of the flow of the molten metal that has actually flowed from the pouring hopper by adding the derived difference in the volume of the flow to the volume of the flow of the molten metal supplied from the holding furnace into the pouring hopper. Further, in the step for stopping the pouring of the molten metal into the mold and the step for intermittently conveying the group of the molds, the weight of the molten metal within the pouring hopper is measured over predetermined repeated periods of time, and the volume of the flow that has been supplied from the holding furnace to the pouring hopper based on that measured weight of the molten metal is derived.

Advantage of the Present Invention

With the above method for automatically pouring molten metal of the present invention, even though the ladle-tilting-type automatic pouring machine is employed, it offers a variety of advantages. For instance, it can provide high-speed pouring adapted to a high-speed molding process in a high-speed molding line.

BRIEF DESCRIPTION OF THE DRAWINGS

The forgoing and other features and advantages of the present invention will be more apparent by the following descriptions of the embodiments in reference to the attached drawings.

FIG. 1 is a front view illustrating the ladle-tilting-type automatic pouring machine that is used in the method for automatically pouring molten metal of the present invention and illustrates one embodiment, in which the method of the present invention is applied to pour the molten metal into a mold that is made by a longitudinal flaskless molding machine.

FIG. 2 is a schematic plan view of the ladle-tilting-type automatic pouring machine of FIG. 1.

FIG. 3 is a front view illustrating one process of the method for pouring the molten metal of the present invention in which a holding furnace supplies the molten metal therefrom to a pouring hopper, while the ladle-tilting-type automatic pouring machine of FIG. 1 pours the molten metal into the mold.

FIG. 4 is a front view illustrating one process of the method for pouring the molten metal of the present invention in which the ladle-tilting-type automatic pouring machine is drained of the molten metal, and thus stops pouring.

FIG. 5 illustrates exemplary pouring patterns. FIG. 5(A) illustrates a pattern in which the rate of the flow of the molten metal is substantially constant over an elapsed time. FIG. 5(B) illustrates a pattern in which the rate of the flow of the molten metal is less in the first half of the elapsed time and is greater in the last half therein. FIG. 5(C) illustrates a pattern in which the rate of the flow of the molten metal is greater in the first half of the elapsed time and is less in the last half therein.

DETAILED DESCRIPTION OF THE INVENTION

The embodiments of the present invention will now be explained in detail, based on the drawings. FIG. 1 illustrates one embodiment, in which the automatic pouring method of the present invention is applied to pour the molten metal into a mold M that is made by a longitudinal flaskless molding machine (not shown). In FIG. 1, a pouring hopper 1, which can store a necessary weight of molten metal for a plurality of cycles of pouring, is located above a site at one outer side of the mold M that is made by the longitudinal flaskless molding machine. Attached to one end of the pouring hopper 1 is a supporting arm 2, which is horizontally extended. In turn, one end of the supporting arm 2 is coupled to a driving mechanism (a motor in this embodiment) 3 for tilting the pouring hopper 1. Preferably, the inner geometry of the pouring hopper 1 forms a shape in which the cross-sectional area of the horizontal plan (the level of the molten metal) is substantially maintained constant, even though the angle that the pouring hopper 1 tilts is varied. These shapes include, for instance, a circular sector, a rectangle, or a square, in the longitudinal section.

At another outer side of the mold M, a traverse frame 4 is arranged. The traverse frame 4 is provided with an elevation frame 5 to raise and lower it. The supporting arm 2 is movably mounted on the upper portion of the elevation frame 5 to move it in the front-back direction.

On the elevation frame 5, a gravimeter (a weight-measuring means for measuring weight) 6 is also mounted to measure the weight of the molten metal in the pouring hopper 1. The gravimeter 6 may, for instance, be a load cell. On the elevation frame 5, an X-direction driving mechanism 7 (a motor in this embodiment) is mounted to move the pouring hopper 1 in the front-back direction (the X-direction) that is perpendicular to the traveling direction (the Y-direction) of the mold M. The pouring hopper 1 can be moved by means of the X-direction driving mechanism 7 in the front-back direction (the X-direction) in unison with the supporting arm 2. Further, on the elevation frame 5, a Z-direction driving mechanism 8 (a motor in this embodiment) is mounted to move the pouring hopper 1 in the vertical direction (the Z-direction). The pouring hopper 1 can be moved by means of the Z-direction driving mechanism 8 in the vertical direction (the Z-direction) in unison with the supporting arm 2 and the elevating frame 5.

Further, on the traverse frame 4, a Y-direction driving mechanism 9 (a motor in this embodiment) is mounted to move the pouring hopper 1 in the traverse direction (the Y-direction). The pouring hopper 1 can be moved in unison by means of the Y-direction driving mechanism 9 in the traverse direction (the Y-direction), the traveling direction of the mold M, and its opposite direction with the traverse frame 4, the elevation frame 5, and the supporting arm 2.

Arranged at one outer side of the pouring hopper 1 is a holding furnace 10 for storing the molten metal and for supplying it into the pouring hopper 1. Tilting cylinders 11 (tilting means for tilting the holding furnace) for tilting the holding furnace 10 are attached thereto. The holding furnace 10 is configured to enable it to be moved in the front-back direction (the X-direction), which is perpendicular to the traveling direction of the mold M, by means of an X-direction driving mechanism (not shown) for it and to enable it to moved in the traveling direction of the mold M and its opposite direction by means of a Y-direction driving mechanism (not shown) for it.

The operation of the pouring machine that is configured as above-described will now be explained. To be ready for pouring the molten metal, the holding furnace 10 supplies the molten metal into the pouring hopper 1 in its horizontal position, to store therein the necessary weight of the molten metal for more than one pouring. At this time, the tilting cylinders 11 are drivingly extended to forwardly tilt the holding furnace 10 such that the molten metal therein is supplied into the pouring hopper 1. The weight measured by means of the gravimeter 6 subtracts the tare weight that is preliminarily measured to measure the weight of the molten metal in the pouring hopper 1. When the weight of the molten metal reaches the predetermined weight, the tilting cylinders 11 are drivingly contracted to inversely tilt the holding furnace 10 to stop the supply of the molten metal into the pouring hopper 1.

One group of the molds M that is made from the longitudinal flaskless molding machine is then intermittently conveyed in the traveling direction, denoted by an arrow Y1 in FIG. 2, by means of a conveying means (not shown) for conveying the molds such that the group of the molds M is conveyed by one pitch (corresponding to the length of one mold M). Therefore, the one mold M to be filled with the molten metal is conveyed on a pouring station S (see FIG. 2).

Because the thickness of the molds M that are made from the longitudinal flaskless molding machine is variable and thus the thickness cannot be maintained constant, the center position of the sprue of each mold M on the pouring station S in its traveling direction cannot be located on the same position each time. Therefore, the center position of the sprue of the mold M on the pouring station S in the traveling direction of it is derived based on data on the thickness of the molds, which data is provided from the longitudinal flaskless molding machine. The pouring hopper 1 is moved by means of the Y-direction driving mechanism 9 based on the derived center position of the sprue such that the center position of the tapping hole of the pouring hopper 1 is aligned with the center position of the sprue of the mold M in the traveling direction of it.

The tilting driving mechanism 3 is then forwardly operated to forwardly tilt the pouring hopper 1 such that the molten metal therein is poured into the mold M on the pouring station S. The tilting cylinders 11 are drivingly extended to forwardly tilt the holding furnace 10 to supply the molten metal therein to the pouring hopper 1 (see FIG. 3), while the pouring hopper 1 pours the molten metal into the mold M. In this pouring step, the gravimeter 6 measures the weight of the molten metal in the pouring hopper 1 every predetermined and repeated period of time, e.g., 0.01 second. Then, a calculating means such as a function of a computer (not shown) derives the difference in the volume of the flow that flows from the pouring hopper 1, based on the weight of the molten metal measured by the gravimeter 6. The calculating means then calculates the actual volume of the flow of the molten metal that has actually flowed from the pouring hopper 1 by adding the derived difference in the volume of the flow to the volume of the flow of the molten metal supplied from the holding furnace 10 into the pouring hopper 1.

Further, data on the weight of a molded product (i.e., the total weight of the molten metal to be poured into the mold M) and data on the pouring pattern (the pattern of the relationship between the elapsed time and the weight of the molten metal) are stored in a computer-readable storage medium (not shown). The calculating means thus calculates the necessary volume of the flow of the molten metal to be poured per the elapsed time based on the stored data on the weight of the molded product and the stored data on the pouring pattern. On the actual volume of the flow of the molten metal that has actually flowed from the pouring hopper 1, a determination is made on whether it matches the derived necessary volume of the flow of the molten metal to be poured per the elapsed time. If unmatched, then the tilting driving mechanism 3 is actuated to adjust the angle that the pouring hopper 1 tilts such that the volume of the flow of the molten metal that has actually flowed from the pouring hopper 1 matches the derived necessary volume of the flow of the molten metal to be poured. For instance, the interval between every adjustment of the volume of the flow of the molten metal may be 0.1 second. Each determination of the volume of the flow of the molten metal that provides a command for actuating the tilting driving mechanism 3 based on the result of the determination may also be carried out by means of the computer.

FIG. 5 illustrates exemplary pouring patterns. FIG. 5(A) illustrates a pattern in which the rate of the flow of the molten metal is substantially constant over an elapsed time. FIG. 5(B) illustrates a pattern in which the rate of the flow of the molten metal is less in the first half of the elapsed time and is greater in the last half. FIG. 5(C) illustrates a pattern in which the rate of the flow of the molten metal is greater in the first half of the elapsed time and is less in the last half.

In the pouring step, the calculating means derives the weight of the molten metal that is poured as compared with the stored weight of the molded product in the computer-readable storing medium based on the measured weight of the molten metal in the pouring hopper 1 that is measured in the pouring step. When the derived weight of the poured molten metal reaches the predetermined weight, the tilting driving mechanism 3 is actuated to inversely tilt the pouring hopper 1 so as to drain the molten metal and thus to stop it from being poured into the mold M (see FIG. 4).

The one group of the molds that includes the molten-metal-poured mold M is then intermittently conveyed in the traveling direction, denoted by an arrow Y1, by means of the conveying means (not shown) for conveying the molds such that the group of the molds M is conveyed by one pitch (corresponding to the length of one mold M). Therefore, the following mold M to be filled with the molten metal is conveyed on a pouring station S and thus the above operations are repeated.

In the step for draining the molten metal to stop pouring it into the mold M and the step for intermittently conveying the group of the molds by one pitch (corresponding to the length of one mold) in the direction denoted by the arrow Y1, if the weight of the molten metal in the pouring hopper 1 has not reached the predetermined weight, then the holding furnace 10 is forwardly tilted to continue supplying the molten metal into the pouring hopper 1. In this step, the gravimeter 6 measures the weight of the molten metal in the pouring hopper 1. In this pouring step, the gravimeter 6 measures the weight of the molten metal in the pouring hopper 1 over the predetermined and repeated period of time, e.g., 0.01 second. The calculating means then calculates the volume of the flow that is supplied from the holding furnace 10 to the pouring hopper 1 based on the weight of the molten metal measured by the gravimeter 6. The angle that the holding furnace 10 tilts is then adjusted to adjust the volume of the flow of the molten metal supplied to the pouring hopper 1 therefrom. This adjustment of the volume of the flow is carried out so that the derived volume of the flow of the molten metal matches the volume of the flow of the molten metal to be added to the pouring hopper 1, to obtain the weight of the poured molten metal in a sufficient amount per mold and per cycle.

If the amount of molten metal in the holding furnace 10 lessens, it is necessary to add some molten metal. Adding the molten metal to the holding furnace 10 will now be explained. To add to the holding furnace 10 the molten metal, first the tilting cylinders 11 are drivingly contracted to inversely tilt the holding furnace 10 to return it to its horizontal position. Then, a ladle (not shown) in which the molten metal is contained moves near the holding furnace 10 by means of a hoist (not shown), which is arranged above the holding furnace 10. The ladle is then tilted to add the molten metal to the holding furnace 10.

As described above, the pouring hopper 1 can store the weight of the molten metal to be poured for more than one pouring. Thus, the weight of the molten metal to be poured in more than one pouring in the pouring hopper 1 is stored before adding the molten metal to the holding furnace 10, and the pouring hopper 1 can also pour the molten metal into the mold M while the holding furnace 10 has added the molten metal to it.

To give one example in view of this advantage, for instance, the time required from beginning the adding of the molten metal to the holding furnace 10 to its completion is about one minute, under the following conditions: the weight of the molten metal in the holding furnace is 2,000 Kg, the weight of the molten metal in the pouring hopper is 150 Kg, the intermittent conveying of the group of the molds by one pitch (corresponding to the length of one mold) is carried out one time per 10.5 seconds, and the weight of the molded product is in a range of 10 Kg to 30 Kg, and 20 Kg on average. If 150 Kg of the molten metal is stored in the pouring hopper 1, because the necessary weight of the molten metal to be poured into one mold is 20 Kg, about 7 molds (150 Kg/20 Kg=7.5) can be poured by using the stored molten metal. Pouring the molten metal for seven molds means that the intermittent conveying of the group of the molds by one pitch (corresponding to the length of one mold) is carried out seven times. Therefore, the time necessary to carry out the intermittent conveying the seven times is 73.5 seconds (=7×10.5 seconds). Thus, no lack of the molten metal occurred during the time period of 73.5 seconds in the absence of a supply of the molten metal from the holding furnace 10 to the pouring hopper 1. In other words, during the time period of about one minute from beginning to add the molten metal to the holding furnace 10 to complete it, there is no suspended state while awaiting the pouring that is caused by a deficiency of the molten metal within the pouring hopper 1, if the holding furnace 10 cannot supply the molten metal to the pouring hopper 1. Therefore, the pouring hopper 1 can continuously pour the molten metal to the molds M without a suspended state occurring while awaiting the pouring that is caused by a deficiency of the molten metal within the pouring hopper 1, while the holding furnace 10 adds the molten metal.

With the present invention, the pouring hopper 1 can store the weight of the molten metal to be poured in more than one pouring. Further, in the time period between beginning of the step for pouring the molten metal into the mold M and the completion of the step for intermittently conveying the group of the molds, if the weight of the molten metal in the pouring hopper 1 has not achieved the predetermined weight, the holding furnace 10 is forwardly tilted, to thereby continue supplying the molten metal into the pouring hopper 1. These features thus result in an advantage in which the pouring hopper 1 can continuously pour the molten metal into the molds M without a suspended state occurring to wait for the pouring that is caused by a lack of the molten metal within the pouring hopper 1, even if the intermittent conveying of the group of the molds is carried out with relatively short time intervals as in a high-speed molding line. Note that the predetermined weight may be set as, for instance, the upper limit of the weight in which no molten metal overflows the pouring hopper 1. In this case, if the weight of the molten metal within the pouring hopper 1 reaches the predetermined weight, the holding furnace 10 is inversely tilted, to thereby stop the supplying of the molten metal to the pouring hopper 1.

Further, with the present invention, in the step for pouring the molten metal into the mold the weight of the molten metal in the pouring hopper 1 is measured per each predetermined and repeated period of time in order to derive a difference in the volume of the flows from the pouring hopper 1 based on the measured weight of the molten metal. The volume of the flow of the molten metal that has actually flowed from the pouring hopper 1 is then derived by adding the derived difference in the volume of the flow to the volume of the flow of the molten metal supplied from the holding furnace 10 into the pouring hopper 1. Further, in the step for stopping the pouring of the molten metal into the mold M and the step for intermittently conveying the group of the molds, the weight of the molten metal in the pouring hopper 1 is measured per each predetermined and repeated period of time in order to derive the volume of the flow that has been supplied from the holding furnace 10 to the pouring hopper 1 based on that measured weight of the molten metal. These features result in an advantage in which the actual volume of the flow from the pouring hopper 1 can be accurately known even during complex operations in which the holding furnace 10 is forwardly tilted to supply the molten metal therefrom to the pouring hopper 1, while the pouring hopper 1 is forwardly tilted to pour the molten metal into the mold M. These features also result in an advantage in which the volume of the flow of the molten metal supplied from the holding furnace 10 to the pouring hopper 1 can be accurately known even under the condition in which the holding furnace 10 is forwardly tilted to supply the molten metal therefrom to the pouring hopper 1 in the step for stopping the pouring of the molten metal into the mold M and the step for intermittently conveying the group of the molds.

Although the automatic pouring method of the present invention is described based on the specified embodiment, the present invention is not intended to be so limited, and thus various modifications and variations may be made without departing from the spirit of the present invention as recited in the accompanying claims. For instance, although the X-direction driving mechanism 7 and the Z-direction driving mechanism 8 are in non-operating conditions in the various described operations in the embodiment, the present invention is not so limited. In the described various operations in the embodiment, the X-direction driving mechanism 7 may move the pouring hopper 1 in the direction (the X-direction) perpendicular to the traveling direction (the Y1 direction in FIG. 2) of the molds M. Also, the Z-direction driving mechanism 8 may vertically move the pouring hopper 1. For instance, when the pouring hopper 1 is forwardly or inversely tilted, it may be simultaneously moved in the direction perpendicular to the traveling direction of the molds M or simultaneously and vertically moved.

Similarly, in the above-mentioned embodiment, although the X-direction driving mechanism for the holding furnace is not operated in the various described operations, the present invention is not limited to this embodiment. The holding furnace 10 may be moved in the direction perpendicular to the traveling direction of the mold M by means of the X-direction driving mechanism for the holding furnace, in the various described operations. Further, if the quantity of the molten metal within the holding furnace 10 becomes less, then instead of adding the molten metal thereto the holding furnace 10 may be moved in the traveling direction of the molds M or in the opposite direction by the Y-direction driving mechanism for the holding furnace, and another holding furnace 10, in which the molten metal has been added, may be opposed at one outer side, i.e., the rearward side, of the pouring hopper 1.

Although the automatic pouring method of the present invention is described as one example of pouring the molten metal into the mold that is made from the longitudinal flaskless molding machine in the above embodiment, the present invention is not intended to be limited to it. Instead of the mold in the above embodiment, the automatic pouring method of the present invention may also be used to pour the molten metal into a flaskless mold that is made by a horizontally parted flaskless molding machine or a tight-flask mold that is made from a horizontally parted tight-flask molding machine.

The invention claimed is:

1. A method for automatically pouring molten metal using an automatic pouring machine that includes a holding furnace for storing and holding the molten metal therein and for supplying the stored molten metal by forwardly tilting the holding furnace, a pouring hopper for receiving the supplied molten metal from the holding furnace and for enabling the storage therein of the received molten metal in a weight for more than one pouring, and tilting means for forwardly and inversely tilting the pouring hopper, the method comprising the steps of:

forwardly tilting the pouring hopper and pouring the molten metal into a mold therefrom, stopping the pouring of the molten metal into the mold by inversely tilting the pouring hopper, and intermittently conveying a group of molds that includes the molten-metal-poured mold, wherein if the weight of the molten metal within the pouring hopper has not reached a predetermined weight, then continually forwardly tilting the holding furnace, to thereby supply the molten metal into the pouring hopper during a period of time between the beginning of the step for pouring the molten metal into the mold and the completion of the step for intermittently conveying the group of the molds and wherein in the step for pouring the molten metal into the mold, measuring the weight of the molten metal within the pouring hopper over predetermined and repeated periods of time, deriving a difference in a volume of a flow from the pouring hopper based on a measured weight of the molten metal, deriving a volume of the flow of the molten metal that has flowed from the pouring hopper by adding the derived difference in the volume of the flow to a volume of a flow of the molten metal supplied from the holding furnace into the pouring hopper; and in the step for stopping the pouring of the molten metal into the mold and the step for intermittently conveying the group of the molds, measuring the weight of the molten metal within the pouring hopper over predetermined and repeated periods of time, and deriving a volume of a flow of molten metal that has been supplied from the holding furnace to the pouring hopper based on that measured weight of the molten metal.

* * * * *